US005344054A

United States Patent [19]

Nutter

[11] Patent Number: 5,344,054

[45] Date of Patent: Sep. 6, 1994

[54] ADJUSTABLE GARMENT HANGER

[76] Inventor: Dale E. Nutter, Rte. 1, Box 4, Little Hocking, Ohio 45742

[21] Appl. No.: 961,263

[22] Filed: Oct. 15, 1992

[51] Int. Cl.[5] ..... A47G 25/44

[52] U.S. Cl. ..... 223/94; 223/89

[58] Field of Search ..... 223/94, 89, 92, 85, 223/88; 211/113; D6/315

[56] References Cited

U.S. PATENT DOCUMENTS

| | | | |
|---|---|---|---|
| 2,335,285 | 11/1943 | Kinney | 223/94 |
| 2,866,583 | 12/1958 | Batts | 223/88 |
| 3,695,491 | 10/1972 | Orlando | 223/91 |
| 3,695,492 | 10/1972 | Sheba | 223/94 |
| 5,044,534 | 9/1991 | Hwang | 223/94 |
| 5,044,535 | 9/1991 | Hunt | 223/95 |
| 5,052,559 | 10/1991 | Platti | 223/94 |
| 5,082,152 | 1/1992 | Chew | 223/85 |

FOREIGN PATENT DOCUMENTS

| | | | |
|---|---|---|---|
| 505486 | 6/1929 | Fed. Rep. of Germany | 223/94 |
| 609712 | 11/1933 | Fed. Rep. of Germany | 223/92 |
| 539294 | 6/1922 | France | 223/94 |
| 984195 | 4/1949 | France | 223/94 |

*Primary Examiner*—Clifford D. Crowder
*Assistant Examiner*—Bibhu Mohanty

[57] ABSTRACT

A garment hanger of a type having opposing longitudinally slotted stationary arms (2), a hook (1), dowel holders (5), and a stationary dowel for hanging lower body clothing (4). Opposing adjustable arms (3) fit into and slide in the longitudinal slots in the stationary arms (2) and are attached by means of tension devices (6). The tension devices (6) allow the opposing adjustable arms to remain in position once adjusted.

4 Claims, 2 Drawing Sheets

3-3

1-1

2-2

4-4

5-5

ADJUSTABLE GARMENT HANGER

BACKGROUND

Field of Invention

This invention relates to garment hangers, specifically to such hangers as are used to hang garments meant for the upper body such as shirts, blouses, sweaters, robes, coats, and jackets.

Description of Prior Art

Nearly everyone uses some type of hanger for storing clothing prior to and following its wearing. The garment hanger has been widely used for many years, but its design has changed very little during that time. Basically, the hanger is traditionally a flattened triangle shape with a hook at the top to accommodate the hanging rod found in most closets. The hanger is made of metal, plastic, wood, or a composite of these materials. The traditional hanger is generally manufactured to be a standard size which is meant to accommodate standard-sized clothing items. The flaw in this arrangement is that not everyone wears the same size clothing. In addition, as clothing styles change, such as with currently fashionable oversize clothing, traditional hangers are not able to adapt to these changes.

Inventors have created several adjustable and collapsible garment hangers, but none has adequately solved the problem of adapting to varied clothing sizes. U.S. Pat. No. 5,044,434 to Ching-Ian Hwang (1990) discloses a collapsible hanger which allows portability but does nothing to solve the problem of varying clothing sizes. This garment hanger does nothing to improve upon the hanging function of the product; rather, it merely attempts to make the hanger more transportable. U.S. Pat. No. 5,044,535 to William J. Hunt (1990) discloses a hanger which is adjustable, but which is meant for lower body garments such as pants or a skirt. This invention does nothing to solve the flaws found in the design of the traditional garment hanger meant for storage of upper body garments. U.S. Pat. No. 3,695,491 to Charles J. Orlando (1970) discloses a hanger which has oppositely extending arms and a garment supporting bar connected between the ends of these arms. This design does not address the problem of adjustability; the device simply provides a positive hold for lower body garments, caused by the weight of the garment itself. U.S. Pat. No. 3,695,492 to Helen Sheba (1970) discloses an adjustable hanger which has both a laterally expandable neck support and laterally expandable side seam shaping supports, but does not address the problem of poor shoulder fit which is the primary cause of stretching and deformation to the shoulder area of knit garments. In addition, Sheba's design lacks simplicity and seems inherently difficult to adjust.

All garment hangers for upper body clothing heretofore known suffer from a number of disadvantages:

(a) If one uses a hanger which is tool large or too small, an item of clothing such as a sweater can be deformed, particularly in the shoulder area, because the entire garment is not being properly supported. Traditional hangers are notorious for mining the shape of knit garments.

(b) As children grow, they wear gradually larger and larger clothing. Hangers meant for young children's clothing cannot be used as the child moves into his or her pre-teen years. Likewise, hangers meant for pre-teen clothing are too small to be used as the child moves into his or her teenage and adult years. Therefor, families often must deal with hangers which are ill-sized for the clothing they wish to store.

(c) Since traditional hangers do not adjust to keep up with the size of a child's clothing as he or she grows, hangers are often discarded once the child no longer wears a garment. This is a very wasteful use of resources.

(d) The most widely used type of hanger today is the wire hanger. This type of hanger is likely to eventually lose its shape due to its inherent flexibility. Once a wire hanger loses its shape, it is discarded. This is a very wasteful use of resources.

OBJECTS AND ADVANTAGES

My invention, the adjustable garment hanger, resolves the problems described in the above section. Several objects and advantages of the present invention are:

(a) to provide a garment hanger which easily adjusts to accommodate a large range of garment sizes and designs.

(b) to provide a garment hanger which adjusts to accommodate knit garments such as sweaters in such a way as to prevent damage through deformation and stretching of the shoulder areas of such garments.

(c) to provide a hanger which has the ability to adapt to changing clothing styles over a long period of time, thus extending the useful life of the product.

(d) to provide a hanger which has adjustable arms for the shoulder areas of garments, which at the same time, provides a dowel (said dowel with or without conventional lower body garment attaching devices such as hooks, clips, etc.) for hanging lower body garments that is not disturbed in any way when adjustments are made to the adjustable arms.

(e) to provide a hanger for children's clothing which will expand with the size of the child's clothing throughout the growing years of the child.

(f) to provide a travel hanger of compact size which can readily be packed in a suitcase, and then quickly expanded to a full standard size when unpacking.

(g) to provide a hanger which is long-lasting and durable.

(h) to provide a hanger which can be constructed of wood, plastic, or metal; or from a combination of these materials.

(i) to provide a hanger, which through long like, durability, and the ability to adapt to changing styles and sizes of clothing, will be much less likely to be discarded and, therefore, less likely to add to current worldwide problems of refuse disposal.

(j) to provide a hanger which can be used by hotels, hospitals, and other institutions to readily adapt to the changing clothing sizes and styles of their clientele.

Further objects and advantages are to provide a garment hanger which can be mass-produced from a variety of materials, which readily meets the changing needs of consumers, and which can be used in a large variety of applications and settings. Still further objects and advantages will become apparent from a consideration of the ensuing description and drawings.

DRAWING FIGURES

In the drawings, pieces mirrored in both the left and right opposing halves of the hanger carry the same number designation.

FIG. 1 shows a top view of the adjustable garment hanger. The left adjustable arm is in the extended position. The hook for hanging the garment hanger on a closet rod is shown in the center. The right adjustable arm is shown removed to illustrate the groove in the stationary arm through which the adjustable arm is attached and in which it slides.

FIG. 2 shows a front view of the adjustable garment hanger. The left adjustable arm is shown extended. The right adjustable arm is shown removed to illustrate its size and design. FIG. 2 also shows the position of the hook and dowel.

DESCRIPTION

FIGS. 1 through 5

Figure 1:
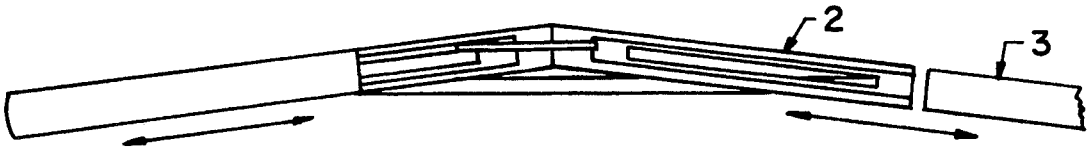
Figure 2:
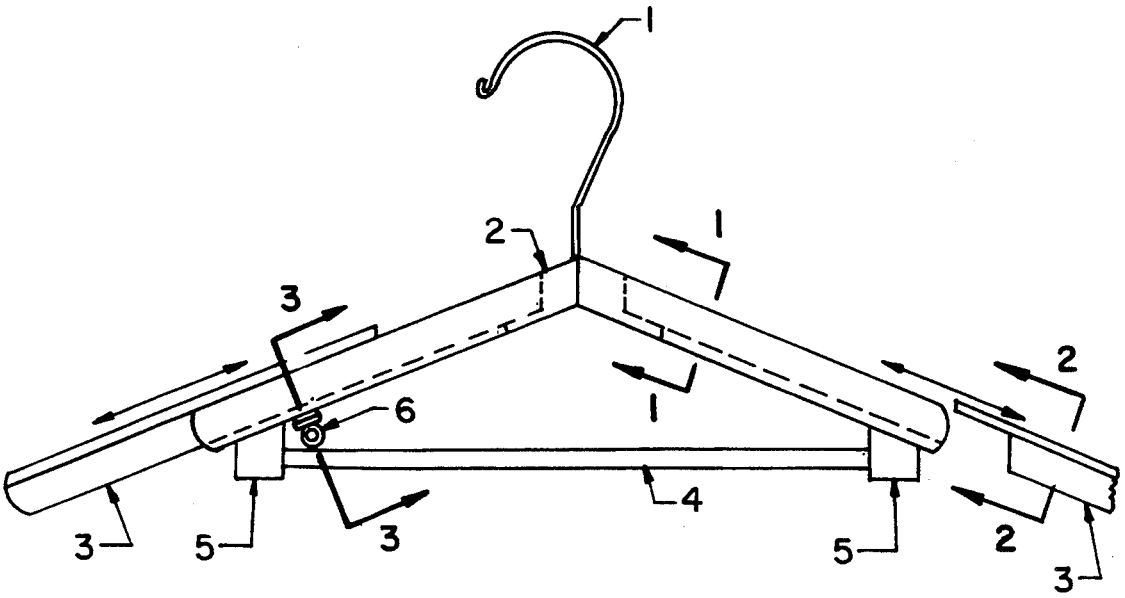
Figure 3:
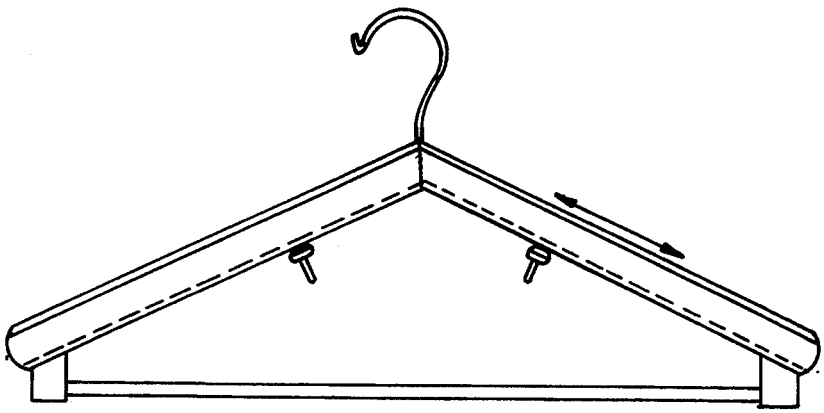
FIG. 3 shows the adjustable garment hanger with both adjustable arms completely retracted.
Figure 4:
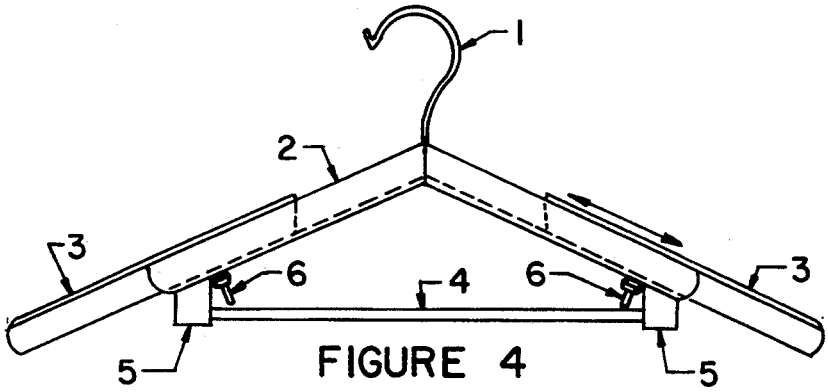
FIG. 4 shows the adjustable garment hanger with both adjustable arms fully extended.

A typical embodiment of the adjustable garment hanger is illustrated in FIG. 1 (top view), FIG. 2 (front view), FIG. 3 (fully retracted view) and FIG. 4 (fully extended view). In this embodiment the body of the hanger is constructed of wood (a hardwood such as oak is suggested for durability and appearance, but a softer wood such as ash or pine is also an acceptable choice), and the hook and tension devices are constructed of metal. However, the manufacturer may also choose to construct the entire hanger or selected parts of the hanger form plastic.

Figure 6:
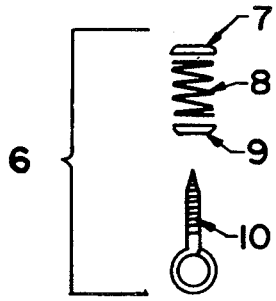
FIG. 6 shows the tension device and it's components.

A pair of stationary arms 2 of the hanger are mirror left and right side opposing pieces which are cut and joined in such a way that they provide: a suitable downward slant to accommodate the normal shape of garment shoulders, a suitable secondary angle form back to front which allows the shoulder areas of the garment to hang slightly forward of the center of the hanger, and a secure housing for a hook 1. Left and right stationary arms 2 are joined together around hook 1 using wood glue in this embodiment. Stationary arms 2 are manufactured with deep slots in which a pair of adjustable arms 3 slide. The slots begin approximately ¾ inch form the center of the .hanger on each side and extend through the end of each stationary arm. These slots are ¾ the depth of the stationary arms 2. The longitudinally central part of each slot has an additional smaller slot which pierces the bottom of each stationary arm for a distance which is approximately one half the length of each stationary arm. It is through these secondary slots that adjustable arms 3 are attached to the body of the hanger by means of a pair of tension devices 6. Drawing A—A in FIG. 6 illustrates a cross section of the described slots.

Attached to the lower opposite ends of the stationary arms are a pair of dowel holders 5, fastened to stationary arms 2 with wood glue, into which each end of a dowel 4 is inserted and fastened with wood glue. Dowel holders 5 could also be fastened with screws, brads, or other types of fasteners. As stated earlier, in a plastic embodiment, stationary arms 2, hook 1, dowel holders 5 and dowel 4 could be manufactured as a single piece of molded plastic.

Figure 7:
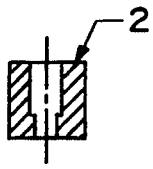
FIG. 7 shows a cross view of the stationary arm from FIG. 2.
Figure 8:
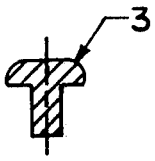
FIG. 8 shows a cross view of the adjustable arm from FIG. 2.

Adjustable arms 3 are of equal length to stationary arms 2 into which they are inserted. Drawing B—B in FIG. 7 illustrates a cross section of adjustable arm 3. The lower portion of the T shape fits into the slot in stationary arm 2. The crossed portion of the T rides on the upper surface of stationary arm 2. In this embodiment, each adjustable arm 3 is manufactured from a single piece of milled hardwood. In a less preferred embodiment, the horizontal and the vertical sections of adjustable arm 3 could be made of separate pieces and then laminated together. In an embodiment manufactured from plastic, each adjustable arm 3 could be made of a single piece of molded plastic.

Adjustable arms 3 are attached to stationary arms 2 by means of tension devices 6. Each tension device consists of four parts: two cupped washers (7,9), a small spring 8, and a self-tapping eyelet screw 10. The tension device is assembled by inserting the first cupped washer 7 onto the eyelet screw 10, with the convex side of the first cupped washer 7 facing the eyelet end of the screw 10, then inserting one small spring 8 onto the eyelet screw 10, such that the end of the spring nearest the eyelet end of the screw is resting inside the circular groove formed by the concave side of the first cupped washer 7, and finally placing the second cupped washer 9 onto the eyelet screw 10, such that the end of the spring furthest from the eyelet end of the screw is resting inside the circular groove formed by the concave side of the second cupped washer 9. The tension device is prepared for insertion by pushing the convex side of the second cupped washer toward the eyelet end of the screw, thus compressing the spring between the cupped washers and fully exposing the threaded tip of the eyelet screw. With adjustable arm 3 in its fully retracted position, the tension device is attached to the garment hanger by first inserting the threaded tip of the eyelet screw through the slot which pierces the bottom of stationary arm 2, and then screwing the threaded tip of the eyelet screw into a pre-drilled hole located in the bottom of adjustable arm 3. Tension device 6 is thus secured to adjustable arm 3, and allows adjustable arm 3 to be moved to any position within the constraint of the slot which pierces the bottom of stationary arm 2. Tension device 6 also allows the tension on adjustable arms 3 to be increased or reduced by tightening or loosening the eyelet screw, which correspondingly alters the tension of the spring that is enclosed between the two cupped washers.

Figure 5:
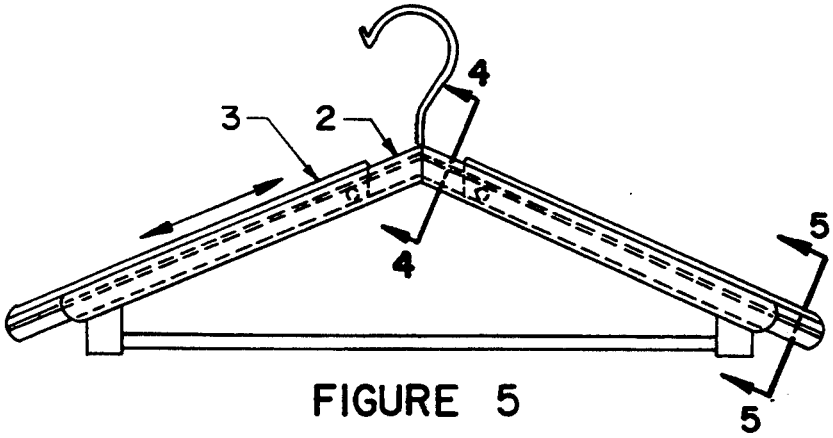
FIG. 5 shows a variation on the design of the adjustable arms. Each of the adjustable arms is partially extended.
Figure 11:
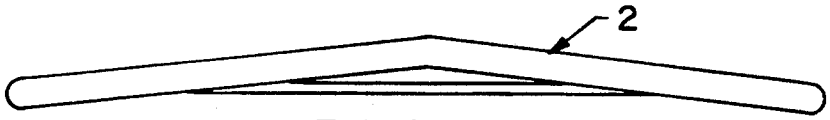
FIG. 11 shows a top view of the hanger from FIG. 5.
Figure 9:
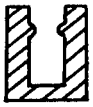
FIG. 9 shows a cross view of the stationary arm from FIG. 5.
Figure 10:
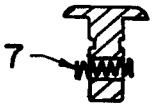
FIG. 10 shows a cross view of the adjustable arm from FIG. 5.

A second embodiment of a tension device is illustrated in FIG. 5. In this embodiment, washer and spring assembly 6 is replaced by a spring 12 which when inserted in a hole drilled through the lower portion of adjustable arm 3 maintains tension on stationary arm 2 by means of friction. In this embodiment, stationary arm 2 has a raised area on each side of the longitudinal slot which fits into grooves on each side of adjustable arm 3 and keeps it in place during and following operation. This arrangement obviates the need for a longitudinal slot piercing the bottom of stationary arm 2. Drawing 9 illustrates a cross section of said design of stationary arm 2 with raised areas which fit into said grooves in adjustable arm 3 as illustrated in cross section drawing 10.

In another embodiment of the adjustable hanger, stationary arms 2 may be constructed as a single piece of wood with hook 1 having the bottom portion manufactured as a threaded self-tapping screw which is attached through a pre-drilled hole. In yet another embodiment, the stationary arms 2, hook 1, dowel holders 5, and dowel 4 could be manufactured of a single piece of molded plastic. Various combinations of elements of these embodiments are also possible.

OPERATION

The manner of using the adjustable garment hanger to store garments is simple. In typical usage, the operation of the adjustable hanger is described from the starting point of a fully retracted position. The fully retracted position is defined as the position such that adjustable arms 3 have been moved as close to hook 1 as possible thus making adjustable arms 3 flush with stationary arms 2. With the adjustable garment hanger in the fully retracted position, one first drapes an upper body garment over stationary arms 2 such that hook 1 protrudes through the upper body garment neck opening, and one then slides each adjustable arm 3 to extend adjustable arm 3 in the direction away from hook 1 until the shoulder areas of the garment are fully supported by each adjustable arm 3.

However, it is not necessary for the adjustable garment hanger to be in the fully retracted position prior to hanging an upper body garment; the adjustable garment hanger may be in any extended position prior to the hanging of an upper body garment, depending on the personal preference of the individual who is hanging the upper body garment. Lower body garments may be draped over dowel 4, or hung from conventional garment attaching devices a (such as hooks, clips, etc.) located on dowel 4, either before or after an upper body garment has been hung, depending on the personal preference of the individual who is hanging the lower body garment.

SUMMARY RAMIFICATIONS, AND SCOPE

Accordingly, the reader will see that by the in and out sliding action of the opposing adjustable arms, the adjustable garment hanger quickly and easily adjust to accommodate a wide range of upper body clothing while at the same time serving secondarily as a hanger for lower body clothing. In addition, the adjustable garment hanger, by virtue of its sturdy construction and adaptable nature, is a garment hanger with a long life of useful service which obviates the need for replacing garment hangers as they lose their shape or as styles change. Furthermore, the adjustable garment hanger has the additional advantages in that:

- it provides a hanger which solves the problem of damage to knit sweaters and other garments through stretching resulting from inadequate support of the garment;
- it provides a hanger which expands as a child grows and wears progressively larger clothing sizes;
- it provides a convenient "miniature-size" hanger which is stored in luggage in its retracted state and then easily expanded to a full standard adult size when a traveler's destination is reached;
- it provides a hanger which when used in large institutions such as hospitals and hotels will provide each patron with a garment hanger ready to adapt to his or her specific needs;
- it permits immediate and easy adjustment of the hanger size when changing from hanging one garment to another;
- it provides a hanger which can be mass-produced from a variety of materials;
- it provides a hanger which through its long life and durability is less likely to be discarded, thus less likely to add to the world pollution crisis.

Although the description above contains many specificities, these should not be construed as limiting the scope of the invention but as merely providing illustrations of some of the presently preferred embodiments of this invention.

Thus the scope of the invention should be determined by the appended claims and their legal equivalents, rather than by the examples given.

I claim:

1. An adjustable garment hanger for storage of clothing comprising: a hook for supporting the hanger, two stationary arms each attached to the hook and each having a slot extending therethrough, an adjustable arm placed in each slot of the stationary arms for longitudinal movement therein, and a tension device to restrict movement of each arm in each slot, said tension device comprising a self-tapping eyelet screw piercing a cupped washer, a spring, and another cupped washer, said tension device attached to said adjustable arm through said slot from the bottom of the stationary arm.

2. The hanger of claim 1 with a dowel attached between the stationary arms.

3. An adjustable garment hanger for storage of clothing comprising: a hook for supporting the hanger, two stationary arms each with a slot therein attached to the hook, an adjustable arm placed in each slot of the stationary arms for longitudinal movement therein, each adjustable arm having a hole drilled therethrough and a spring placed in the hole, the adjustable arm being placed in the slot of the stationary arm and having movement therein restricted by engagement of the spring in the hole with the slot.

4. The hanger of claim 2 with a dowel attached between the stationary arms.

* * * * *